US012256888B2

(12) United States Patent
Perry et al.

(10) Patent No.: US 12,256,888 B2
(45) Date of Patent: Mar. 25, 2025

(54) CORDLESS SURFACE CLEANING APPARATUS

(71) Applicant: BISSELL Inc., Grand Rapids, MI (US)

(72) Inventors: Joseph P. Perry, Comstock Park, MI (US); Fabrizio Mirandola, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 259 days.

(21) Appl. No.: 18/084,605

(22) Filed: Dec. 20, 2022

(65) Prior Publication Data

US 2024/0197128 A1 Jun. 20, 2024

(51) Int. Cl.
*A47L 9/28* (2006.01)
*A47L 9/30* (2006.01)

(52) U.S. Cl.
CPC ..... *A47L 9/2831* (2013.01); *A47L 9/2842* (2013.01); *A47L 9/2847* (2013.01); *A47L 9/2884* (2013.01); *A47L 9/30* (2013.01)

(58) Field of Classification Search
CPC .... A47L 9/2831; A47L 9/2842; A47L 9/2847; A47L 9/2884; A47L 9/30
See application file for complete search history.

(56) References Cited

U.S. PATENT DOCUMENTS

| | | | | |
|---|---|---|---|---|
| 3,715,775 | A | 2/1973 | Nickelson | |
| 4,686,736 | A | 8/1987 | Petralia et al. | |
| 7,780,796 | B2 | 8/2010 | Shim et al. | |
| 10,561,290 | B2 * | 2/2020 | Pi | A47L 9/2884 |
| 11,160,431 | B2 * | 11/2021 | Nguyen | A47L 9/2857 |
| 11,229,338 | B2 * | 1/2022 | Royale | A47L 11/4016 |
| 2019/0298133 | A1 * | 10/2019 | Conrad | H01M 10/6566 |
| 2020/0154968 | A1 * | 5/2020 | Terry | A47L 11/4044 |
| 2020/0315418 | A1 | 10/2020 | Howard et al. | |
| 2020/0405112 | A1 | 12/2020 | Terry | |
| 2021/0007569 | A1 * | 1/2021 | Howard | A47L 9/2821 |
| 2021/0038042 | A1 * | 2/2021 | Morgan | A47L 9/2863 |
| 2021/0204780 | A1 * | 7/2021 | Pohlman | A47L 11/4019 |
| 2021/0251451 | A1 * | 8/2021 | Ko | A47L 9/281 |
| 2021/0251453 | A1 * | 8/2021 | Howard | A47L 13/16 |
| 2022/0104671 | A1 | 4/2022 | Pohlman | |
| 2024/0180380 | A1 * | 6/2024 | Lee | A47L 5/24 |

FOREIGN PATENT DOCUMENTS

| | | | | |
|---|---|---|---|---|
| CN | 207220759 U * | 4/2018 | | A47L 5/362 |
| DE | 102019211014 A1 * | 1/2021 | | A47L 5/30 |
| EP | 4144271 A1 * | 3/2023 | | A47L 11/302 |

(Continued)

OTHER PUBLICATIONS

WO-2023140592-A1—English Machine Translation (Year: 2023).*

*Primary Examiner* — Marc Carlson
(74) *Attorney, Agent, or Firm* — Warner Norcross + Judd LLP

(57) ABSTRACT

A surface cleaning apparatus includes a battery powering one or more electric components. The surface cleaning apparatus can have a power conversation mode that is executed by a controller. The surface cleaning apparatus can be provided with a sensing unit configured to detect inactivity of the surface cleaning apparatus and the controller is configured to receive a signal from the sensing unit to execute the power conservation mode based on the signal.

20 Claims, 3 Drawing Sheets

(56) References Cited

FOREIGN PATENT DOCUMENTS

| | | | | | |
|---|---|---|---|---|---|
| EP | 4212083 | A1 | * | 7/2023 | ..... A47L 11/4008 |
| GB | 2554780 | A | * | 4/2018 | ..... A47L 5/22 |
| GB | 2596859 | A | * | 1/2022 | ..... A47L 9/0411 |
| GB | 2624132 | A | * | 5/2024 | ..... A47L 9/2842 |
| IT | BG20110025 | | | 12/2012 | |
| JP | 6748727 | B2 | * | 9/2020 | ..... A47L 5/36 |
| KR | 20150006689 | A | * | 1/2015 | |
| KR | 20190054326 | A | * | 5/2019 | |
| WO | WO-2019083836 | A1 | * | 5/2019 | ..... A47L 11/4011 |
| WO | WO-2023140592 | A1 | * | 7/2023 | ..... A47L 9/0477 |

* cited by examiner

CORDLESS SURFACE CLEANING APPARATUS

BACKGROUND

Cordless surface cleaning apparatus such as cordless vacuum cleaners, wet/dry cleaners, mops, and other floor cleaners are popular with many users because they are lightweight, easy to maneuver, and require less storage space. However, one drawback of battery-powered floor cleaners is that they often have a short runtime before requiring recharging.

To provide a longer runtime, some cordless cleaners are low-powered, i.e. supply low power to certain electrical components. For example, reducing the power supplied to a suction motor increases overall runtime, but negatively affects cleaning performance. Providing a longer runtime is challenging for high-powered floor cleaners, such as those offering greater suction power, as these features consume more power and deplete the battery quicker. Additionally, when a user pauses during cleaning but does not power off the floor cleaner, battery power is unnecessarily consumed.

One prior solution to this provides a cordless floor cleaner with a trigger that must be held down to power the floor cleaner. When the user releases the trigger, power is cut off. While this can increase runtime when used properly, many users complain about the requirement to hold the trigger down while cleaning. Providing a user-friendly cordless floor cleaner remains a challenge in the floor cleaning industry.

BRIEF SUMMARY

A battery-powered surface cleaning apparatus with increased active cleaning time and reduced power consumption is provided herein.

In one aspect of the disclosure, a surface cleaning apparatus includes a housing, a battery powering at least one electrical component, a sensing unit configured to detect inactivity of the surface cleaning apparatus, and a controller configured to execute a power conservation mode when the surface cleaning apparatus is inactive.

In another aspect of the disclosure, a surface cleaning apparatus includes a housing adapted for movement over a surface to be cleaned and having a suction inlet and an agitator configured to agitate the surface to be cleaned, a handle coupled with the housing and adapted to be gripped by a user to move the housing over the surface to be cleaned, a suction source in fluid communication with the suction inlet and comprising a vacuum motor, an agitator motor coupled with the agitator to drive the agitator, a battery configured to supply power to the vacuum motor and the agitator motor, a sensing unit disposed on the housing and configured to detect inactivity of the surface cleaning apparatus by sensing movement of the surface cleaning apparatus and/or user interaction with the surface cleaning apparatus, and a controller configured to receive, from the sensing unit, a signal indicative of inactivity of the surface cleaning apparatus, transition the surface cleaning apparatus from an active mode to an inactive mode based on the signal, monitor an elapsed time of inactivity, execute a first power conservation mode based on a first elapsed time of inactivity, execute a second power conservation mode based on a second elapsed time of inactivity, and turn off the surface cleaning apparatus based on a third elapsed time of inactivity.

In yet another aspect of the disclosure, a surface cleaning apparatus includes a housing adapted for movement over a surface to be cleaned, a handle coupled with the housing and adapted to be gripped by a user to move the housing over the surface to be cleaned, at least one electrical component disposed on the housing, a battery configured to supply power to the at least one electrical component, a sensing unit disposed on the housing and configured to detect inactivity of the surface cleaning apparatus by sensing movement of the surface cleaning apparatus and/or user interaction with the surface cleaning apparatus, and a controller configured to receive, from the sensing unit, a signal indicative of inactivity of the surface cleaning apparatus, transition the surface cleaning apparatus from an active mode to an inactive mode based on the signal, monitor an elapsed time of inactivity, and execute a power conservation mode based on a first elapsed time of inactivity.

In still another aspect of the disclosure, a method of controlling a surface cleaning apparatus includes sensing inactivity of the apparatus via a sensing unit configured to detect inactivity of the surface cleaning apparatus by sensing movement of the surface cleaning apparatus and/or user interaction with the surface cleaning apparatus, receiving, via a controller, a signal indicative of inactivity of the surface cleaning apparatus, transitioning the surface cleaning apparatus from an active mode to an inactive mode based on the signal, monitoring an elapsed time of inactivity, executing a first power conservation mode based on a first elapsed time of inactivity, executing a second power conservation mode based on a second elapsed time of inactivity, and turning off the surface cleaning apparatus based on a third elapsed time of inactivity.

These and other features and advantages of the present disclosure will become apparent from the following description of particular embodiments, when viewed in accordance with the accompanying drawings and appended claims.

Before the aspects of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DETAILED DESCRIPTION

A cordless or battery-powered surface cleaning apparatus having an improved runtime is described below. The battery-powered surface cleaning apparatus, also referred to herein as the "apparatus" or the "floor cleaner" has at least one cleaning system for cleaning a surface, such as floor surfaces like carpet, rugs, wood, tile, and the like, or above-floor surfaces like countertops, furniture, and the like. The battery powers at least one electrical component of the cleaning system. In an exemplary embodiment, the floor cleaner is configured to enter a power conservation mode during periods of inactivity. As will be appreciated from the description herein, the power conservation mode has myriad use applications, but is generally used to increase the active cleaning time available before having to recharge the battery. As but one example, the power conservation mode can reduce power to or shut off at least one electrical component of the floor cleaning during a period of inactivity, i.e. when a user is not actively cleaning. At least some aspects of the power conservation mode described herein function through the various elements thereof, as described below, to reduce the rate of temperature rise of the battery, thus allowing for more efficient use of the available power in the battery.

Figure 2:
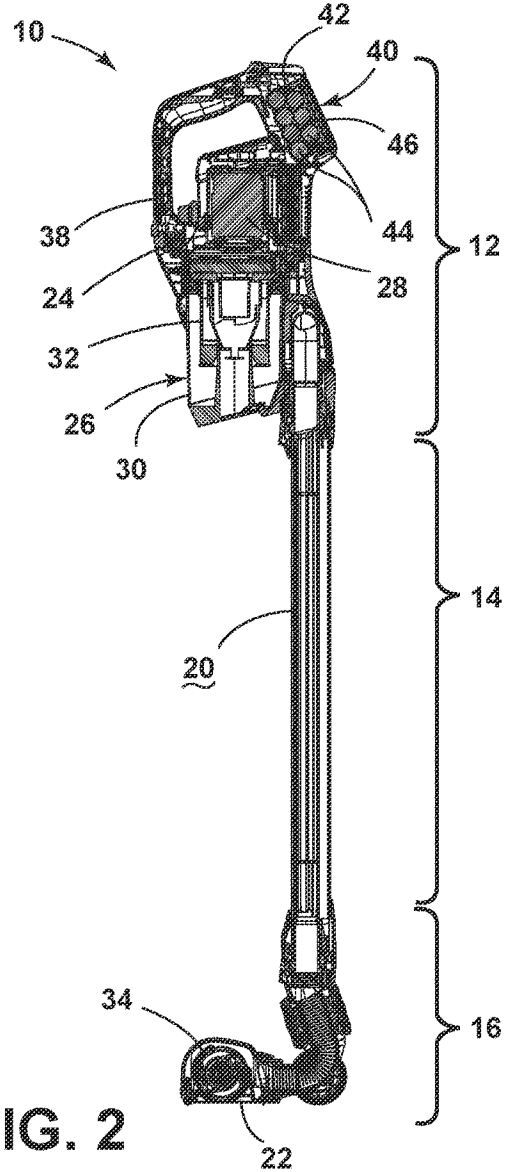
FIG. 2 is a cross-sectional view of the surface cleaning apparatus taken through line II-II of FIG. 1.
Figure 1:
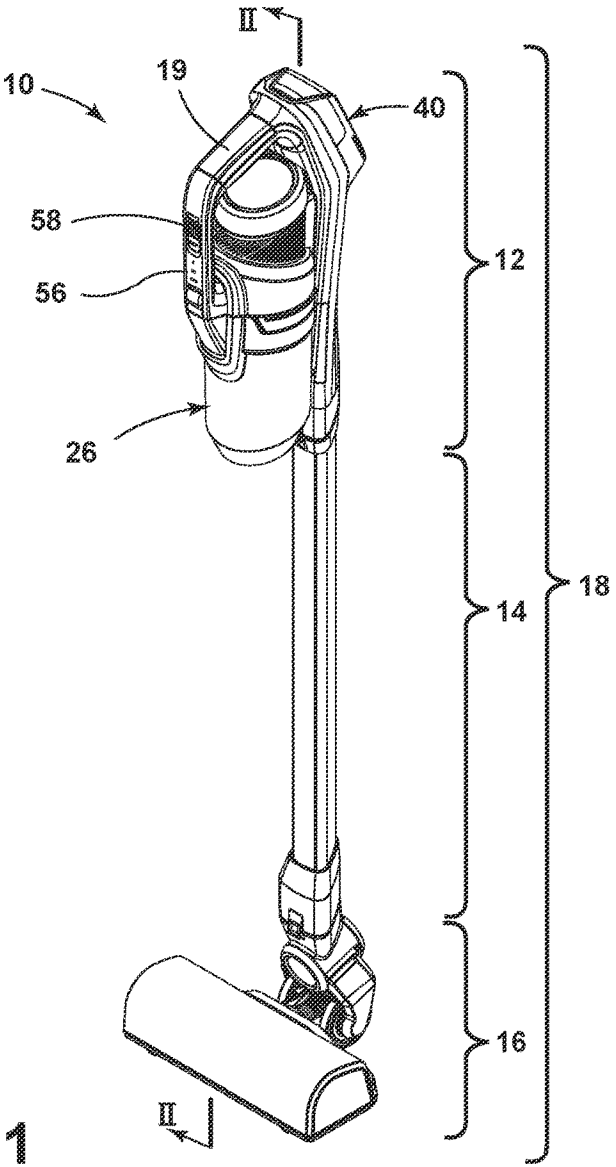
FIG. 1 is a perspective view of a cordless or battery-powered surface cleaning apparatus in the form of a vacuum cleaner according to one embodiment of the present disclosure.

FIGS. 1-2 show a surface cleaning apparatus 10, also referred to herein as floor cleaner 10, provided with various features and improvements, including a battery 40 powering the floor cleaner 10 and having a power conservation mode to reduce power consumption and preserve battery runtime. Although various embodiments of the present disclosure are described in connection with a cordless or battery-powered surface cleaning apparatus, it is fully contemplated that one or more embodiments may apply to a corded surface cleaning apparatus in order to reduce power consumption from an electrical grid or external power source during periods of inactivity.

The floor cleaner 10 can be a vacuum cleaner having a vacuum cleaning system. The functional systems of the exemplary vacuum cleaner 10 can be arranged into any desired configuration including as an upright or stick vacuum as shown, a portable cleaner adapted to be hand carried by a user for cleaning relatively small areas, or a canister cleaner having a hose or other conduit forming a portion of the working air conduit between a nozzle and a suction source.

The floor cleaner 10 includes a housing 18 adapted for movement across a surface to be cleaned. The various cleaning systems and components thereof can be supported by the housing 18. The floor cleaner 10 of the illustrated embodiment includes a main unit 12, a wand 14 and a surface cleaning head 16, which may collectively form the housing 18.

The floor cleaner 10 may be is convertible between different modes of operation to efficiently clean different surface types and hard-to-reach areas. The main unit 12 and wand 14 may collectively form an upright assembly coupled with the cleaning head 16. In another embodiment, instead of a wand 14, the upright assembly can include an upright body coupled with the cleaning head 16, and the main unit 12 is detachable from the upright body.

The floor cleaner 10 has a handle 19 coupled with the housing 18 and adapted to be gripped by a user to move the housing 18 over the surface to be cleaned. As shown in FIGS. 1-2, the handle 19 is part of the main unit 12 for convenient gripping in the different modes of operation for the convertible floor cleaner 10.

The floor cleaner 10 can include one or more cleaning systems. In one embodiment, the floor cleaner 10 has a vacuum collection system, also referred to herein as a recovery system, for creating a partial vacuum to suck up debris (which may include dirt, dust, soil, hair, and other debris) from a surface to be cleaned and collecting the removed debris in a space provided on the floor cleaner 10 for later disposal. In some cases, the collection or recovery system is also configured to remove and collect liquid from the surface to be cleaned. Other cleaning systems include, but are not limited to a cleaning fluid delivery system, i.e. a liquid delivery system and/or a steam delivery system.

The vacuum collection system can include a recovery pathway 20, a suction inlet 22 to the recovery pathway 20, a suction source 24 in fluid communication with the suction inlet 22 for generating a debris- and/or liquid-laden working fluid stream, and a debris removal assembly 26 for removing and collecting debris (which can be solid, liquid, or a combination thereof) from the working fluid stream for later disposal. The suction source 24 can comprise a vacuum motor 28. In addition to the aforementioned components, the vacuum collection system may include one or more filters, upstream or downstream of the suction source 24, to separate debris from the working airstream.

The debris removal assembly 26 can include a collection container 30 for separating and collecting debris from the working airstream for later disposal. A separator 32 can be formed in a portion of the collection container 30 for separating entrained debris from the working air stream, and comprises a filter assembly provided downstream of the suction inlet 22 and upstream of the suction source 24. Alternatively, the debris removal assembly 26 can include a cyclonic or centrifugal separator, a flexible and air-permeable filter bag, or other air filtering means.

The cleaning head 16 can comprise a base adapted to move over a surface to be cleaned, e.g. a surface-engaging and/or floor-traversing base, and can include a suction nozzle that defines the suction inlet 22. The cleaning head 16 can house one or more floor cleaning implements or agitators, such as a brushroll 34. The brushroll 34 can be provided within or adjacent to the suction inlet 22 to agitate the surface to be cleaned so that the debris is more easily ingested into the suction inlet 22. Other examples of floor cleaning implements include, but are not limited to dual horizontally-rotating brushrolls, one or more vertically-rotating brushrolls, a stationary brush, and/or a cleaning pad. A brush motor 36 (FIG. 3) may be operably coupled with the brushroll 34 via a transmission arrangement, which can include one or more belts, gears, shafts, pulleys, or combinations thereof.

The vacuum cleaner 10 can include a main controller 38 operably coupled with the various systems and components of the vacuum cleaner 10. In one embodiment the main controller 38 can comprise a printed circuit board ("PCB"). As used herein, unless otherwise noted, the term "PCB" includes a printed circuit board having a plurality of electrical and electronic components that provide operational control to the vacuum cleaner 10. The PCB includes, for example, a processing unit (e.g., a microprocessor, a microcontroller, or another suitable programmable device) and a memory (e.g., a read-only memory ("ROM"), a random access memory ("RAM"), an electrically erasable programmable read-only memory ("EEPROM"), a flash memory, or another suitable magnetic, optical, physical, or electronic memory device). The processing unit is connected to the memory and executes instructions (e.g., software) that is capable of being stored in the RAM (e.g., during execution), the ROM (e.g., on a generally permanent basis), or another non-transitory computer readable medium such as another memory or a disc. Additionally or alternatively, the memory is included in the processing unit (e.g., as part of a microcontroller). Software stored in memory includes, for example, firmware, program data, one or more program modules, and other executable instructions. The processing unit is configured to retrieve from memory and execute, among other things, instructions related to the control processes and methods described herein. The PCB can also include, among other things, a plurality of additional passive and active components such as resistors, capacitors, inductors, integrated circuits, and amplifiers. These components are arranged and connected to provide a plurality of electrical functions to the PCB including, among other things, signal conditioning or voltage regulation. For descriptive purposes, a PCB and the electrical components populated on the PCB are collectively referred to as a controller. Thus, the main PCB and the electrical components populated on the main PCB may be referred to as main controller 38.

The vacuum cleaner 10 is "cordless" and has a battery 40 electrically connected to at least one electrical component thereof. In one embodiment, the battery is rechargeable. A cord (not shown) may be used to connect the battery to an external power source for charging the battery and/or for connecting the battery to powered components in the vacuum cleaner 10.

In one embodiment, the battery 40 is a battery pack, and is preferably rechargeable. In one example, the rechargeable battery pack is a lithium ion battery. The battery pack 40 includes a casing 42 and one or more batteries 44 enclosed within the casing 42. The battery pack 40 may include a separate battery controller 46, alternatively referred to herein as battery PCB, that controls charging and discharging of the battery pack 40 and can communicate with the main controller 38. The battery PCB 46 is also enclosed with the casing 42.

The vacuum cleaner 10 can include at least one user interface 56 through which a user can interact with the vacuum cleaner 10. The user interface 56 can enable operation and control of the apparatus 10 from the user's end, and can also provide feedback information from the vacuum cleaner 10 to the user. The user interface 56 can be electrically coupled with electrical components, including, but not limited to, circuitry electrically connected to various components of the vacuum collection system of the vacuum cleaner 10. The user interface 56 may be located on the handle 19, or elsewhere on the vacuum cleaner 10.

In one embodiment, the user interface 56 includes at least one input control 58, such as, but not limited to, a button, trigger, toggle, key, switch, or the like, to affect and control operation of the vacuum cleaner 10. In one embodiment, the input control 58 is a power control that controls the supply of power to one or more electrical components of the vacuum cleaner 10. Other examples of input controls include a mode button that cycles the vacuum cleaner 10 between different cleaning modes. The user interface 56 can include at least one indicator, such as, but not limited to, a battery level indicator or a suction level indicator. The user interface 56 can include a display 52, a speaker 54, or both (FIG. 3).

Figure 3:
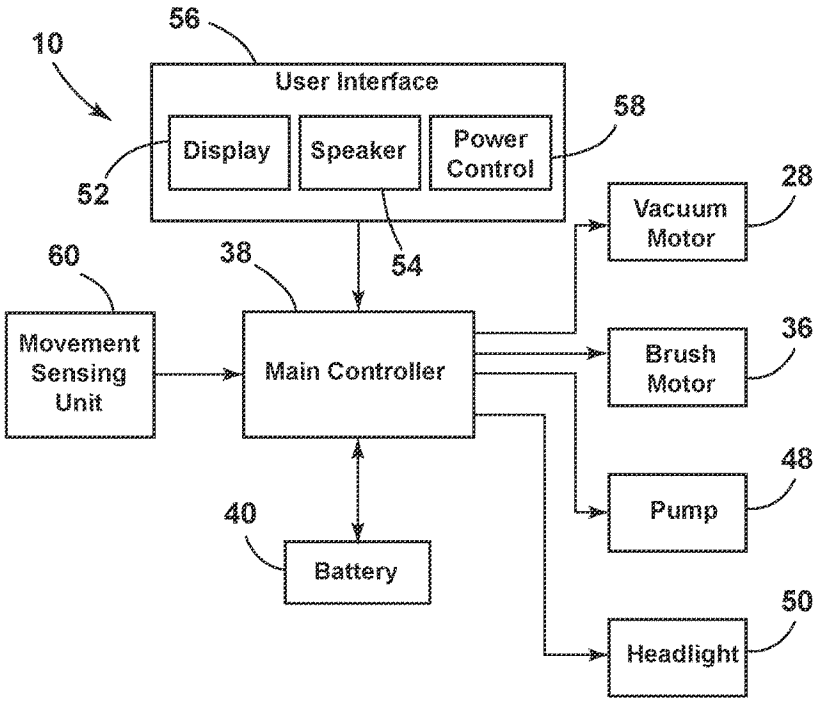
FIG. 3 is a schematic view of the surface cleaning apparatus of FIG. 1.

FIG. 3 is a schematic view of various functional systems of the vacuum cleaner 10. The battery 40 can supply power to the vacuum motor 28, the brush motor 36, the main controller 38, and/or the user interface 56. In other embodiments, the battery 40 can supply power to at least one other electronic component, including, but not limited to a pump 48, a headlight 50, or any combination thereof.

The vacuum cleaner 10 can comprise a power conservation mode to preserve battery life during periods of inactivity. Inactivity of the vacuum cleaner 10 can be defined as no movement of the vacuum cleaner 10 within a predetermined period of time, the vacuum cleaner 10 being in an inactive position or orientation for a predetermined period of time, no user interaction with the vacuum cleaner 10 within a predetermined period of time or any combination thereof. Inactivity may be defined as no movement of or user interaction with the vacuum cleaner 10 for at least 5 seconds, alternatively at least 10 seconds, alternatively at least 15 seconds, alternatively at least 20 seconds, alternatively at least 25 seconds, alternatively at least 30 seconds. It will be understood by those skilled in the art that the vacuum cleaner 10 can use a different modality to define inactivity in order to preserve battery life in accordance with the principles of the present disclosure.

In one aspect of the disclosure, the vacuum cleaner 10 can comprise a sensing unit 60 configured to detect inactivity by sensing at least one of: movement of the vacuum cleaner 10, position or orientation of the vacuum cleaner 10, or user interaction with the vacuum cleaner. The controller 38 can be configured to reduce power consumption when inactivity is detected by the sensing unit 60. When activity of the vacuum cleaner 10 is detected by the sensing unit 60, the vacuum cleaner 10 may operate in an active mode in which one or more electrical components are fully powered.

In one embodiment, the sensing unit 60 comprises a movement sensing unit 60 configured to detect inactivity by detecting movement of the vacuum cleaner 10, and the controller 38 can be configured to reduce power consumption when no movement of the vacuum cleaner 10 is detected by the movement sensing unit 60. When movement of the vacuum cleaner 10 is detected by the movement sensing unit 60, the vacuum cleaner 10 may operate in an active mode in which one or more electrical components are fully powered.

The movement sensing unit 60 can comprise one or more sensors or sensing components, examples of which include, but are not limited to, a motion activated switch, a wheel motion sensor, a detent switch, an accelerometer, or any combination thereof. The movement sensing unit 60, or a sensor or sensing component thereof, can be electrically-powered by the battery 40 in some embodiments.

According to one or more embodiments, the vacuum cleaner 10, or similar surface cleaning apparatus, may include a wireless module having at least one wireless radio for wirelessly connecting to a network through a wireless access point or router. In such embodiments, the movement sensing unit 60 may include inputs or sensors to detect movement, or lack thereof, of the vacuum cleaner 10 using signal strength of a wireless signal (e.g., Wi-FI signal) received by the wireless radio. For example, the movement sensing unit 60 may employ received signal strength indicator (RSSI) values to indicate movement of the vacuum cleaner 10. A steady or stable signal strength measurement of the wireless signal may be indicative of lack of movement or inactivity of the vacuum cleaner, whereas a fluctuating or varying signal strength may be indicative of activity.

The movement sensing unit 60 can be disposed on the housing 18 of the vacuum cleaner 10 in a location to detect movement of the vacuum cleaner 10. The one or more sensors or sensing components may be located, for example, on the main unit 12, the wand 14, or on the cleaning head 16. For example, in the case of a wheel motion sensor, the movement sensing unit 60 can be disposed at least partially on a wheel of the cleaning head 16. In the case of an accelerometer, the movement sensing unit 60 can be disposed at least partially on the main unit 12 and/or the wand 14.

The movement sensing unit 60 may be configured output a signal, which can include power, resistance, current, or a voltage signal, for example, that is relayed to the main controller 38, and which can be used as an input to selectively reduce power consumption.

In one embodiment, the sensing unit 60 can comprise a position or orientation sensing unit 60 configured to detect inactivity by detecting an inactive position or orientation of the vacuum cleaner 10, e.g. a position or orientation in which the vacuum cleaner 10 is not actively cleaning. One non-limiting example of an inactive position or orientation is the upright assembly (e.g., the main unit 12 and wand 14) in a vertical or upright position relative to the cleaning head 16 (see FIG. 1). The position or orientation sensing unit 60 can comprise one or more sensors or sensing components, examples of which include, but are not limited to, a motion activated switch, a detent switch, an accelerometer, or any combination thereof.

In one embodiment, the sensing unit 60 can comprise a user interaction sensing unit 60 configured to detect inactivity by detecting a lack of user interaction with the vacuum cleaner 10, for example by detecting when a user is or is not physically touching the vacuum cleaner 10. One non-limiting example of a user interaction is the user gripping the handle 19 and/or pressing the input control 58, which may be, but is not limited to, a button, trigger, toggle, key, switch, or the like (FIG. 1). The user interaction sensing unit 60 can comprise one or more sensors or sensing components, examples of which include, but are not limited to, a capacitive sensor, a trigger microswitch, or any combination thereof.

In one aspect of the disclosure, during inactivity, the vacuum cleaner 10 enters a power conservation mode in which the main controller 38 executes one or more operations to reduce power consumption and preserve battery runtime. Reducing power consumption in the power reduction mode may comprise turning off at least one electrical component of the vacuum cleaner 10, or reducing power supplied to at least one electrical component of the vacuum cleaner. For example, in one embodiment, the vacuum motor 28 may be turned off when no activity of the vacuum cleaner 10 is detected by the sensing unit 60. In another embodiment, the vacuum motor 28 may be switched to a low power mode, i.e. for reduced suction power at the inlet 22, when no activity of the vacuum cleaner 10 is detected by the sensing unit 60. In an additional embodiment, power may be reduced to, or removed from, one or more other electrical components of the vacuum cleaner 10, such as brush motor 36, pump 48, headlight 50, or sensing unit 60. In one or more embodiments, reducing power to these other electrical components may be in addition to, or instead of, reducing power to the vacuum motor 28.

In one aspect of the disclosure, the vacuum cleaner 10 can have multiple different power conservation modes. The main controller 38 may use one or more variables to determine which power conservation mode to execute. In one embodiment, the power conservation mode executed is based on, at least in part, a length of time of inactivity, i.e. how long the vacuum cleaner 10 has been inactive. The time to return to an active mode may vary between different power conservation modes.

Figure 4:
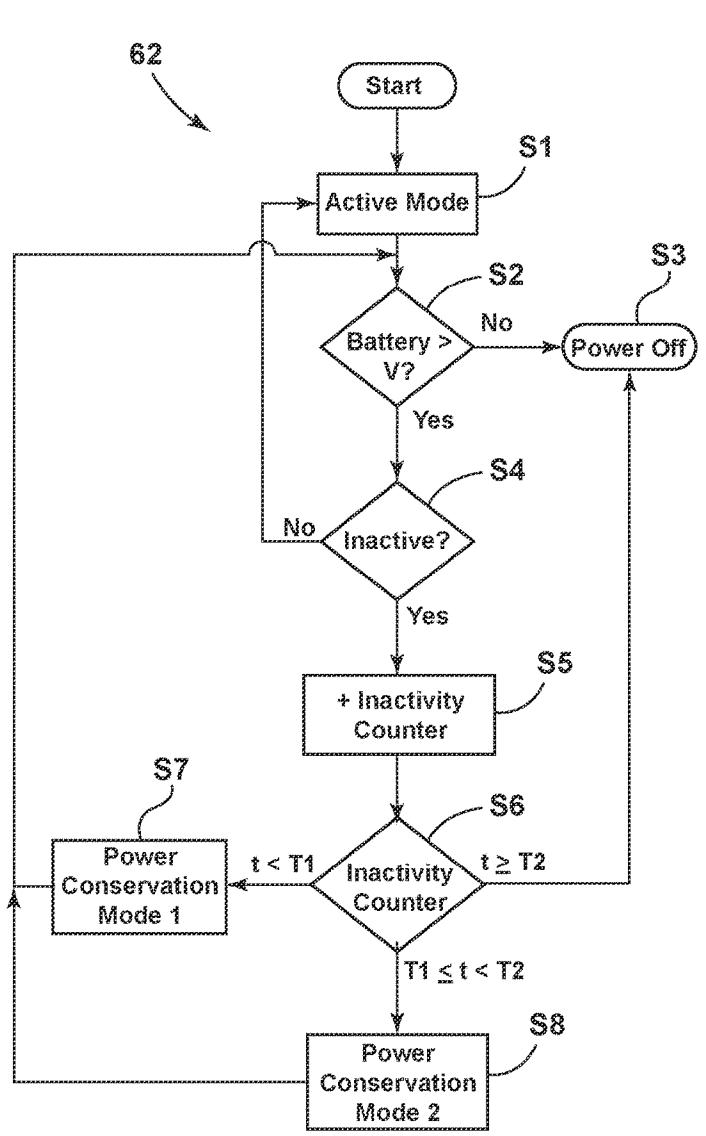
FIG. 4 is a flow chart depicting a method for controlling a surface cleaning apparatus to conserve energy.

A method 62 of controlling a surface cleaning apparatus, such as the vacuum cleaner 10, is shown in FIG. 4. The sequence of steps discussed is for illustrative purposes only and is not meant to limit the method in any way as it is understood that the steps may proceed in a different logical order, additional or intervening steps may be included, or described steps may be divided into multiple steps, without detracting from the present disclosure.

The method 62 begins with the vacuum cleaner 10 in an active mode (step S1), in which the vacuum cleaner 10 is actively cleaning. During active cleaning, a user is moving the vacuum cleaner 10 over a surface to be cleaned, one or more electrical components of the vacuum cleaner are powered by the battery 40. For example, in the active mode, the vacuum motor 28 may operate at an RPM>0 and/or the brush motor 36 may operate at an RPM>0.

If, during active cleaning, the battery charge level drops below a threshold value V (step S2), the vacuum cleaner 10 powers off (step S3). One non-limiting example of a threshold value is 10% charge. In such a case, if the battery charge level drops below 10% during active cleaning, the vacuum cleaner 10 powers off and all electrical components of the vacuum cleaner are turned off. During an inactive or power saving mode of the vacuum cleaner 10, if the battery charge level drops below 10%, the vacuum cleaner 10 may also power off and turn any active electrical components of the vacuum cleaner off.

Step S3 may include providing a user notification representing that the vacuum cleaner 10 is powering off. For example, the display 52 can show a visual notification representing that is vacuum cleaner 10 is powering off and/or the speaker 54 can output an audible notification representing that is vacuum cleaner 10 is powering off.

When inactivity of the vacuum cleaner 10 is detected (step S4), the vacuum cleaner 10 can enter an inactive mode. Whether or not the vacuum cleaner 10 is inactive may be judged based, for example, on movement of the vacuum cleaner 10 (or lack thereof), the position or orientation of the vacuum cleaner 10, and/or user interaction with the vacuum cleaner 10 (or lack thereof), for example detected by the sensing unit 60. Inactivity may be defined as a lack of detectable movement, lack of detectable user interaction, and/or the vacuum cleaner 10 being in an inactive position or orientation for a predefined period of time (e.g. 1-30 seconds, alternatively 10 seconds, alternatively 5 seconds). Therefore, when the sensing unit 60 detects inactivity, the controller 38 may execute a power conservation mode.

In embodiments where the vacuum cleaner 10 has multiple power conservation modes, the elapsed inactive time, i.e. how long the vacuum cleaner 10 has been inactive is used by the controller 38 to determine which power conservation mode to execute. Therefore, when the sensing unit 60 does not detect activity, the controller 38 may start an inactivity counter (step S5), which can comprise a clock or timer, and which counts inactivity time as counter value t. When inactivity of the vacuum cleaner 10 is detected, the counter value t may increase from an initial value of zero.

The elapsed inactive time is monitored in step S6. If the counter value t is less than a first reference value T1, the main controller 38 executes a first power conservation mode (step S7). In one non-limiting example, the first reference value T1 is 30 seconds.

In the first power conservation mode, power is reduced to the vacuum motor 28 and/or the brush motor 36. In one embodiment, the vacuum motor 28 and the brush motor 36 are both turned off in the first power conservation mode. According to one or more embodiments, the speaker 54 may output a simulated vacuum noise in the first power conservation mode. The controller 38, the user interface 56, and the sensing unit 60 may remain active, e.g. fully powered, in the first power conservation mode. Other electrical components may remain awake but placed in a low-power state. In another embodiment of the first power conservation mode, all electrical components of the vacuum cleaner 10 are turned off, except for the controller 38 and the sensing unit 60.

If the counter value t equals or exceeds the first reference value T1, and is less than a second reference value T2, the main controller 38 may execute a second power conservation mode (step S8). In one non-limiting example, the second reference value T2 is 120 seconds.

In the second power conservation mode, all electrical components of the vacuum cleaner 10 may be turned off, or may remain turned off, except for the controller 38 and the sensing unit 60. According to one or more embodiments, the user interface 56, and in particular a display or LED indicator of the user interface 56, may also remain active in the second power conservation mode.

If the counter value t equals or exceeds the second reference value T2, the vacuum cleaner 10 completely powers off (step S3), including the user interface 56. The counter value t exceeding the second reference value T2 may indicate that a user has stopped cleaning altogether, and so the vacuum cleaner 10 is powered off to cease all power draw on the battery 40.

The method may include providing a user notification representing that the vacuum cleaner 10 is in an inactive mode. For example, the user interface 56 can output a visual and/or audible notification representing that the vacuum cleaner 10 is in the first power conservation mode if a time during which the vacuum cleaner is inactive is less than the first reference value T1. The user interface 56 can output a visual and/or audible notification representing that the vacuum cleaner 10 is in the second power conservation mode if a time during which the vacuum cleaner is inactive equals or exceeds the first reference value T1 but is less than the second reference value T2. The method may further include providing a user notification representing that the vacuum cleaner 10 is powering off if a time during which the vacuum cleaner is inactive equals or exceeds the second reference value T2.

During method 62, if activity of the vacuum cleaner 10 is detected, the vacuum cleaner can re-enter the active mode. There may be delay in returning to the active mode depending on the current power conservation mode. For example, in switching to the active mode from the first power conservation mode, there may be relatively quick (less than 1 second) ramp up of the main power functions to be resumed. In switching to the active mode from the second power conservation mode, there may be a longer (greater than 1 second) ramp up of the main power functions to be resumed.

Whether or not the vacuum cleaner 10 is active may be judged based, for example, based on input from the sensing unit 60. Therefore, when the sensing unit 60 detects activity, the controller 38 may switch to the active mode, and may stop the inactivity counter, and resets the counter value t to zero.

The method 62 may include providing a user notification representing that the vacuum cleaner 10 is re-entering the active mode. For example, the display 52 can show a visual notification representing that is vacuum cleaner 10 is actively cleaning. Audible feedback is also provided by the activation of the vacuum and/or brush motors 28, 36.

For a surface cleaning apparatus having a fluid delivery system including pump 48, the pump 48 may operate at a flow a rate of >0 ml/min in the active mode, at 0 ml/min in the first power conservation mode, and at 0 ml/min in the second power conservation mode.

For a surface cleaning apparatus including headlight 50, the headlight may be illuminated in a first state in the active mode, in a second state in the first power conservation mode, and may be turned off completely in the second power conservation mode. In one example of the first state, the headlight may be illuminated at a first brightness level and/or may be illuminated in a steady state (e.g. in a continuously on state). In one example of the second state, the headlight may dim to a second, lower brightness level and/or be illuminated in a non-steady state (e.g. in a blinking or breathing pattern).

As one skilled in the art will appreciate, switching between the active and inactive modes is automatic, e.g. does not require pressing the power control 58 or other user-controllable actuator, and may be controlled based on detected inactivity and/or activity of the vacuum cleaner 10.

In addition to reducing power consumption and preserving battery runtime, the method 62 also allows heat on the battery 40 to dissipate when the vacuum cleaner 10 is in an inactive mode. This can prevent overheating of the battery 40, and can delay or avoid a shut-off due to hitting the thermal limit of the battery 40.

As one skilled in the art will appreciate, other power conservation modes may be executed by the main controller 38 at step S7 and/or S8. Table 1 below lists some examples of power conservation modes for the vacuum cleaner 10. For each example, "Mode 1" may be executed in step S7 and "Mode 2" may be executed in step S8.

TABLE 1

| | | Vacuum Motor | Brush Motor | Pump |
|---|---|---|---|---|
| Example 1 | Mode 1 | ON/LOW | ON/LOW | N/A |
| | Mode 2 | OFF | OFF | N/A |
| Example 2 | Mode 1 | ON/LOW | ON/HIGH | N/A |
| | Mode 2 | OFF | OFF | N/A |
| Example 3 | Mode 1 | ON/LOW | ON/HIGH | N/A |
| | Mode 2 | ON/LOW | ON/LOW | N/A |
| Example 4 | Mode 1 | ON/HIGH | ON/HIGH | OFF |
| | Mode 2 | OFF | OFF | OFF |
| Example 5 | Mode 1 | ON/LOW | ON/LOW | OFF |
| | Mode 2 | OFF | OFF | OFF |

Although the figures have thus far shown aspects and embodiments of the present disclosure in the context of a cleaning apparatus comprising a stick-type, convertible vacuum cleaner, it is recognized that numerous variations are possible whereby the aspects and embodiments of the present disclosure be configured for incorporation into virtually any type of cordless surface cleaning apparatus. According to the present disclosure, the surface cleaning apparatus can be any apparatus capable of cleaning, treating, or disinfecting a surface to be cleaned. The surface cleaning apparatus can include, but is not limited to any of the following: a wet/dry vacuum cleaner, an autonomous floor cleaner, an unattended spot-cleaning apparatus or deep cleaner, an upright deep cleaner or extractor, a handheld extractor, a vacuum cleaner, a sweeper, a mop, a steamer, an ultraviolet radiation disinfecting device, a treatment dispensing device, and combinations thereof.

Figure 5:
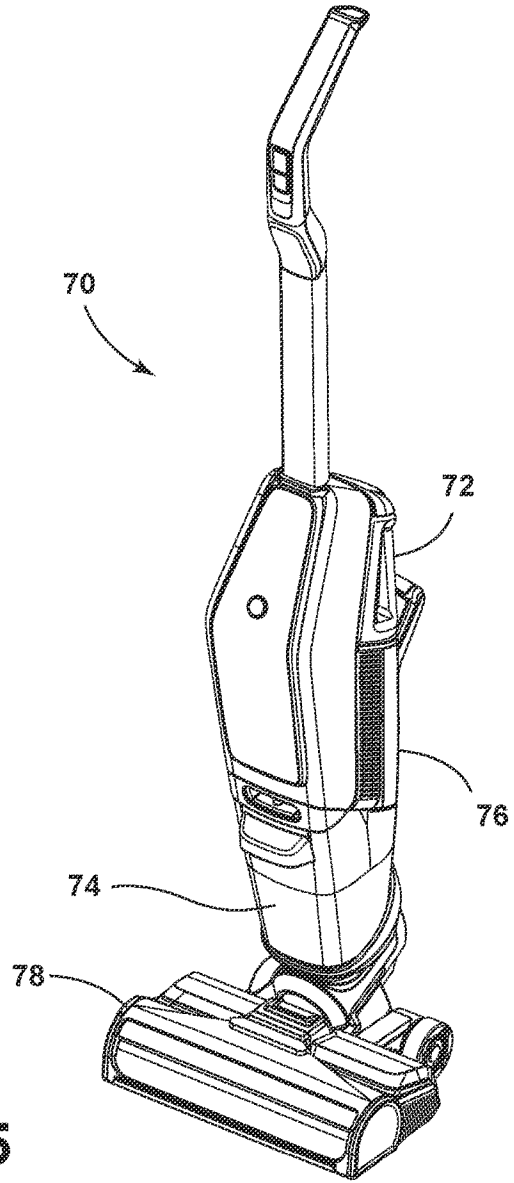
FIG. 5 is a perspective view of a surface cleaning apparatus in the form of a wet/dry multi-surface cleaner according to another embodiment of the present disclosure

FIG. 5 show a surface cleaning apparatus in the form of a wet/dry vacuum cleaner or wet/dry multi-surface cleaner 70 that is cordless or battery-powered according to any of the aspects and embodiments described herein. The floor cleaner 70 can be used to clean hard floor surfaces such as tile and hardwood and soft floor surfaces such as area rugs and carpet. The floor cleaner 70 has a fluid delivery system including a supply tank 72 for storing cleaning fluid and dispenser (not shown) delivering the cleaning fluid to the surface to be cleaned, and a recovery system for removing spent cleaning fluid and debris from a surface to be cleaned and storing the spent cleaning fluid and debris in an onboard recovery tank 74. The floor cleaner 70 includes an upright handle assembly or body 76 and a cleaning foot or base 78 mounted to or coupled with the upright body 76 and adapted for movement across a surface to be cleaned. The various cleaning systems and components thereof can be supported by either or both the base 78 and the upright body 76. A non-limiting example of a wet/dry multi-surface cleaner is disclosed in U.S. Pat. No. 11,160,431, issued Nov. 2, 2021, which is incorporated herein by reference in its entirety.

Figure 6:
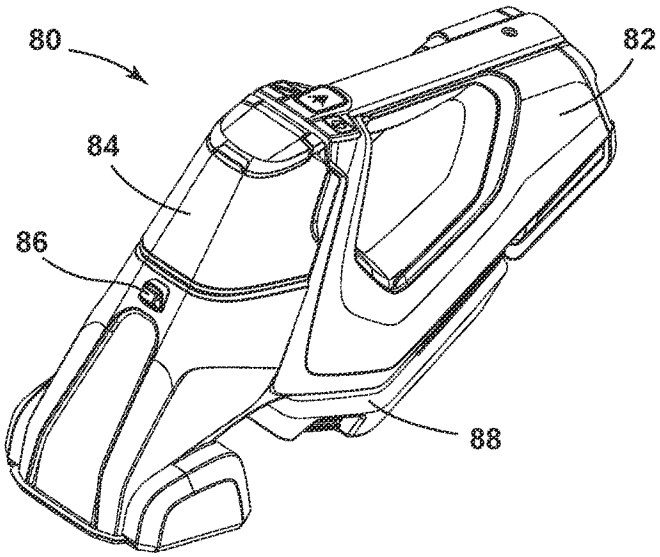
FIG. 6 is a perspective view of a surface cleaning apparatus in the form of a portable extraction cleaner according to another embodiment of the present disclosure.

FIG. 6 shows a surface cleaning apparatus in the form of a portable extraction cleaner 80 that is cordless or battery-powered according to any of the aspects and embodiments described herein. The portable extraction cleaner 80 comprises a hand-carried body 82 and has a fluid delivery system carried on the body 82 and including a supply tank 84 for storing cleaning fluid and dispenser 86 delivering the cleaning fluid to the surface to be cleaned. The portable extraction cleaner 80 also has a recovery system carried on the body 82 for removing spent cleaning fluid and debris from a surface to be cleaned and storing the spent cleaning fluid and debris in a recovery tank 88 onboard the body 82. A non-limiting example of a portable extraction cleaner is disclosed in U.S. Pat. No. 11,229,338, issued Jan. 25, 2022, which is incorporated herein by reference in its entirety.

Figure 7:
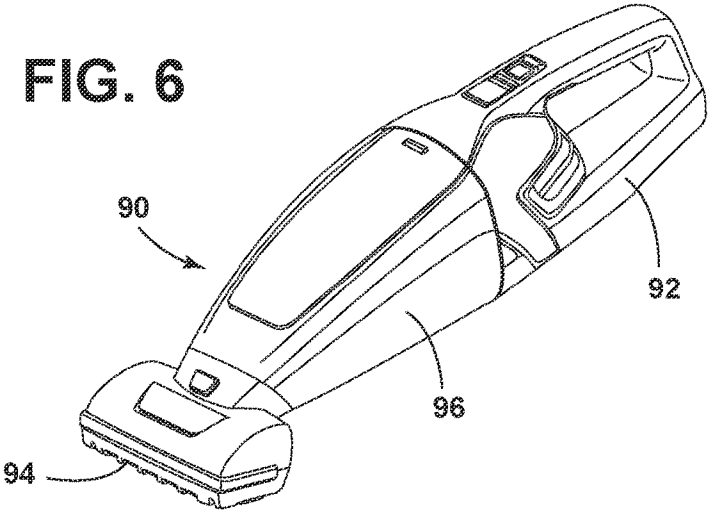
FIG. 7 is a perspective view of a surface cleaning apparatus in the form of an handheld vacuum cleaner according to another embodiment of the present disclosure.

FIG. 7 shows a surface cleaning apparatus in the form of a handheld vacuum cleaner 90 that is cordless or battery-powered according to any of the aspects and embodiments described herein. The handheld vacuum cleaner 90 comprises a hand-carried body 92 and has a vacuum collection system for creating a partial vacuum to suck up debris from a surface to be cleaned and collecting the removed debris in a space on the body 92 for later disposal. The vacuum collection system includes a recovery pathway, a suction inlet 94, a suction source (not shown) in fluid communication with the suction inlet 94 for generating a debris-laden working air stream, and the collection container 96 for separating and collecting debris from the working air stream for later disposal. A non-limiting example of a handheld vacuum cleaner is disclosed in U.S. Pat. No. 10,561,290, issued Feb. 18, 2020, which is incorporated herein by reference in its entirety.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. A surface cleaning apparatus comprising:

a housing adapted for movement over a surface to be cleaned and having a suction inlet and an agitator configured to agitate the surface to be cleaned;

a handle coupled with the housing and adapted to be gripped by a user to move the housing over the surface to be cleaned;

a suction source in fluid communication with the suction inlet and comprising a vacuum motor;

an agitator motor coupled with the agitator to drive the agitator;

a battery configured to supply power to the vacuum motor and the agitator motor;

a sensing unit disposed on the housing and configured to detect inactivity of the surface cleaning apparatus by sensing at least one of:

movement of the surface cleaning apparatus; and user interaction with the surface cleaning apparatus; and a controller configured to:

receive, from the sensing unit, a signal indicative of inactivity of the surface cleaning apparatus;

transition the surface cleaning apparatus from an active mode to an inactive mode based on the signal;

monitor an elapsed time of inactivity;

execute a first power conservation mode based on a first elapsed time of inactivity;

execute a second power conservation mode based on a second elapsed time of inactivity; and turn off the surface cleaning apparatus based on a third elapsed time of inactivity.

2. The surface cleaning apparatus of claim 1, wherein transitioning the surface cleaning apparatus from the active mode to the inactive mode includes starting a counter to track the elapsed time of inactivity.

3. The surface cleaning apparatus of claim 1, wherein, when the surface cleaning apparatus is in the first power conservation mode and the elapsed time exceeds a first threshold value, the controller transitions the surface cleaning apparatus to the second power conservation mode.

4. The surface cleaning apparatus of claim 3, wherein, when the surface cleaning apparatus is in the second power conservation mode and the elapsed time exceeds a second threshold value, the controller turns the surface cleaning apparatus off.

5. The surface cleaning apparatus of claim 1, wherein, when the surface cleaning apparatus is in the active mode, the battery supplies power to at least the vacuum motor.

6. The surface cleaning apparatus of claim 1, wherein, when the surface cleaning apparatus is in the active mode, the battery supplies power to the vacuum motor and the agitator motor.

7. The surface cleaning apparatus of claim 1, wherein the vacuum motor operates at a first power level in the active mode, operates at a lower power level or is off in the first power conservation mode, and is off in the second power conservation mode.

8. The surface cleaning apparatus of claim 1, wherein the agitator motor operates at >0 RPM in the active mode, at 0 RPM in the first power conservation mode, and at 0 RPM in the second power conservation mode.

9. The surface cleaning apparatus of claim 1, wherein the controller is configured to turn off the surface cleaning apparatus in response to a charge level of the battery falling below a predetermined threshold value that is greater than zero.

10. The surface cleaning apparatus of claim 1, wherein the sensing unit comprises at least one of a motion activated switch, a wheel motion sensor, a detent switch, an accelerometer, a capacitive sensor, and a trigger microswitch.

11. The surface cleaning apparatus of claim 1, comprising a fluid delivery system including a pump, the battery configured to supply power to the pump, wherein the pump is on in the active mode, and wherein the pump is off in the first power conservation mode and in the second power conservation mode.

12. The surface cleaning apparatus of claim 1, comprising a headlight, the battery configured to supply power to the headlight, wherein the headlight is illuminated in first state in the active mode, the headlight is illuminated in second state in the first power conservation mode, and the headlight is turned off in the second power conservation mode.

13. The surface cleaning apparatus of claim 1, comprising a user interface, wherein the battery supplies power to the user interface in the active mode, in the first power conservation mode, and in the second power conservation mode.

14. The surface cleaning apparatus of claim 13, wherein the user interface is configured to provide a user notification representing that the surface cleaning apparatus is in the first power conservation mode if the elapsed time is less than a first threshold value and a user notification representing that the surface cleaning apparatus is in the second power conservation mode if the elapsed time meets or exceeds the first threshold value.

15. The surface cleaning apparatus of claim 1, wherein the housing comprises:

a cleaning head having the suction inlet and the agitator; and an upright assembly pivotally connected to the cleaning head;

wherein the upright assembly comprises the vacuum motor, the battery, and the controller.

16. The surface cleaning apparatus of claim 15, wherein the upright assembly comprises a detachable main unit comprising the vacuum motor, the battery, and the controller.

17. The surface cleaning apparatus of claim 1, wherein the battery is a rechargeable battery pack.

18. A method of controlling a surface cleaning apparatus, comprising:

sensing inactivity of the surface cleaning apparatus via a sensing unit configured to detect inactivity of the surface cleaning apparatus by sensing at least one of:

movement of the surface cleaning apparatus; and user interaction with the surface cleaning apparatus;

receiving, via a controller, a signal indicative of inactivity of the surface cleaning apparatus;

transitioning the surface cleaning apparatus from an active mode to an inactive mode based on the signal;

monitoring an elapsed time of inactivity;

executing a first power conservation mode based on a first elapsed time of inactivity;

executing a second power conservation mode based on a second elapsed time of inactivity; and turning off the surface cleaning apparatus based on a third elapsed time of inactivity.

19. The method of claim 18 wherein the surface cleaning apparatus comprises a vacuum motor that operates at a first power level in the active mode, and wherein executing the first power conservation mode comprises one of:

operating the vacuum motor at a second power level that is lower than the first power level; and turning off the vacuum motor.

20. The method of claim 18 wherein the surface cleaning apparatus comprises an agitator motor that operates at >0 RPM in the active mode, and wherein executing the first power conservation mode comprises operating the agitator motor at 0 RPM.

* * * * *